US007077735B2

(12) United States Patent
Krondorfer et al.

(10) Patent No.: US 7,077,735 B2
(45) Date of Patent: Jul. 18, 2006

(54) SYSTEM WITH A TOOL-HOLDING FIXTURE

(75) Inventors: Harald Krondorfer, Ludwigsburg (DE); Markus Heckmann, Leinfelden-Echterdingen (DE); Thomas Schomisch, Leinfelden-Echterdingen (DE); Johann Huber, Kramsach (AT)

(73) Assignees: Robert Bosch GmbH, Stuttgart (DE); Tyrolit Schleifmittel Swarovski K.G., Schwaz (AT)

( * ) Notice: Subject to any disclaimer, the term of this patent is extended or adjusted under 35 U.S.C. 154(b) by 0 days.

(21) Appl. No.: 10/381,536

(22) PCT Filed: Jul. 2, 2002

(86) PCT No.: PCT/DE02/02400

§ 371 (c)(1),
(2), (4) Date: Mar. 26, 2003

(87) PCT Pub. No.: WO03/011527

PCT Pub. Date: Feb. 13, 2003

(65) Prior Publication Data

US 2004/0012160 A1 Jan. 22, 2004

(30) Foreign Application Priority Data

Jul. 26, 2001 (DE) ..... 101 36 459

(51) Int. Cl.
*B24B 27/08* (2006.01)

(52) U.S. Cl. ..... 451/359; 451/518; 451/819

(58) Field of Classification Search ..... 451/508, 451/509, 514–516, 518, 519, 359
See application file for complete search history.

(56) References Cited

U.S. PATENT DOCUMENTS

| | | | | | |
|---|---|---|---|---|---|
| 1,811,037 | A | * | 6/1931 | Albertson et al. | 451/490 |
| 1,928,800 | A | * | 10/1933 | Stever | 451/509 |
| 2,385,249 | A | * | 9/1945 | Osbern | 451/509 |
| 2,747,343 | A | * | 5/1956 | Gellert | 451/342 |
| 3,158,972 | A | * | 12/1964 | Mackay Jr., et al. | 451/509 |
| 3,266,200 | A | * | 8/1966 | Block | 451/509 |
| 3,270,467 | A | * | 9/1966 | Block et al. | 451/509 |
| 3,574,978 | A | * | 4/1971 | Block | 451/509 |
| 3,623,281 | A | * | 11/1971 | Moffat | 451/509 |
| 4,839,998 | A | * | 6/1989 | Block | 451/509 |
| 5,707,275 | A | * | 1/1998 | Preis et al. | 451/342 |
| 6,786,811 | B1 | * | 9/2004 | Krondorfer et al. | 451/342 |

FOREIGN PATENT DOCUMENTS

| | | | |
|---|---|---|---|
| DE | 15 77 422 | A | 4/1970 |
| EP | 0 904 896 | A2 | 3/1999 |
| WO | 01 76816 | A | 10/2001 |
| WO | WO 01/76822 | A1 * | 10/2001 |

* cited by examiner

*Primary Examiner*—M. Rachuba
(74) *Attorney, Agent, or Firm*—Michael J. Striker

(57) ABSTRACT

A system with a tool-holding socket, which has a driver device that can be used to operationally connect an insert tool to a drive shaft, and has an insert tool, wherein the insert tool can be operationally connected to the driver device by at least one detent element which is supported so that can move in opposition to a spring element, engages in detent fashion in an operating position of the insert tool, and fixes the insert tool in a positively engaging fashion, wherein at least part of a mechanism for preventing a laterally inverted installation of the insert tool is formed at least onto the tool-holding socket.

10 Claims, 4 Drawing Sheets

SYSTEM WITH A TOOL-HOLDING FIXTURE

BACKGROUND OF INVENTION

The invention is based on a system with a tool-holding socket according to the preamble to claim 1.

EP 0 904 896 A2 has disclosed a system with a grinder tool-holding socket for a hand-held angle grinder and a grinding wheel. The angle grinder has a drive shaft with a thread at the tool end.

The grinder tool-holding socket has a driver and a clamping nut. In order to mount a grinding wheel, the driver is slid with a mounting opening onto a collar of the drive shaft and is clamped against a support surface of the drive shaft in a frictionally engaging manner by means of the clamping nut. The driver has an axially extending collar on the tool side, which has recesses on its outer circumference on two opposite sides, which extend to a base of the collar in the axial direction. Starting from each of the recesses, a groove extends on the outer circumference of the collar, counter to the drive direction of the drive shaft. The grooves are closed at the end oriented counter to the drive direction of the drive shaft and, starting from the recesses, taper axially in the direction counter to the drive direction of the drive shaft.

The grinding wheel has a hub with a mounting opening, which contains two tabs oriented radially inward on opposite sides. The tabs can be inserted into the recesses in the axial direction and then introduced into the grooves in the circumference direction counter to the drive direction. The grinding wheel is fixed in a positively engaging manner in the axial direction by means of the tabs in the grooves and is fixed in a frictionally engaging manner by the tapering contour of the grooves. During operation, the frictional engagement increases due to the reaction forces acting on the grinding wheel, which act counter to the drive direction.

In order to prevent the grinding wheel from coming off the driver while the drive shaft is being braked, in the vicinity of a recess on the circumference of the collar, a stopper is provided, which is supported in an opening in an axially movable fashion. In an operating position with the grinding wheel pointing downward, the force of gravity moves the stopper axially toward the grinding wheel and the stopper closes the groove in the direction of the recess and prevents the tab disposed in the groove from moving in the drive direction of the drive shaft.

SUMMARY OF THE INVENTION

The invention is based on a system, which has with a tool-holding socket with a driver device that can be used to operationally connect an insert tool to a drive shaft, and has an insert tool.

The invention proposes that it be possible to operationally connect the insert tool to the driver device by means of at least one detent element, which is supported so that it can move in opposition to a spring element, engages in detent fashion in an operating position of the insert tool, and fixes the insert tool in a positively engaging fashion, where at least a part of a mechanism for preventing the insert tool from being mounted in a laterally inverted fashion is formed onto at least the tool-holding socket. Damage to or destruction of insert tools, in particular of rotation direction-bonded diamond cutting wheels, can be advantageously avoided and damage to the hand-held machine tool during operation as a result of laterally inverted mounting can be prevented. Particularly in hand-held machine tools whose insert tool can be mounted or changed in an especially quick and simple fashion by means of a fast-acting clamp system, it is particularly important to prevent an unsafe fastening of the insert tool due to a laterally inverted incorrect mounting.

Advantageously, the driver device has at least one function element, which constitutes at least part of the mechanism. Existing components can advantageously be used, thus obviating the need for additional components to produce the mechanism.

The mechanism can be embodied in various ways, for example the mechanism can be comprised of a specially formed clamping hook, which in the event of a laterally inverted installation of the insert tool, prevents a rotating motion required to complete the installation.

In order to prevent a laterally inverted installation, it is particularly advantageous to provide a corresponding coding on the tool-holding socket and on the insert tool, which coding constitutes the mechanism for preventing the insert tool from being mounted in a laterally inverted fashion. Even a laterally inverted placement of the insert tool onto the tool-holding socket can advantageously be prevented; an inexpensive and simple protection against incorrect installation can be achieved through the use of existing components, thus obviating the need for additional components. The coding can be comprised of various components deemed appropriate by one skilled in the art. However, it is particularly advantageous for the coding to be comprised at least in part by a function element, for example a clamping hook or a detent element, which secures the insert tool in the circumference direction.

In order to achieve an inexpensive and simple coding, the function element has a projected area in the direction of the insert tool, which projected area is designed to be asymmetrical to an axis that intersects a rotation axis of the insert tool at right angles, the insert tool having an opening that is at least partially congruent to the projected area and corresponds to the function element.

In another embodiment, the invention proposes that the insert tool have a disk-shaped hub comprised of a separate component. This makes it possible to achieve a hub that can be inexpensively and easily produced. The hub can be comprised of a special material, in particular a sheet metal, so that an opening, which corresponds to the function element, can be exactly produced in it in a particularly simple and inexpensive manner, e.g. by means of a punching process. Instead of being made of sheet metal, however, the hub can also be made of other materials deemed appropriate by one skilled in the art, e.g. a plastic, a glass fiber, a composite, etc. and/or can be formed onto the insert tool and be of one piece with it.

In particular, the insert tool has a hub with a shaped part oriented in the axial direction. A protection of the function elements can be simply and inexpensively achieved and in addition, the shaped part can advantageously prevent the insert tool from being mounted in a laterally inverted position. If the hub is comprised of a sheet metal component, the shaped part can be inexpensively shaped using a deep-drawing process.

The shaped part can have various shapes deemed appropriate by one skilled in the art. If the hub has a cup-shaped design and extends over a larger area in the central region of the hub, then this permits the shaped part to be shaped using a simple tool and permits a high stability of the hub to be achieved at the same time. Furthermore, particularly in hand-held machine tools that have a safety guard, a positive engagement of the function element with an opening of the hub of the insert tool can be prevented in the event of a laterally inverted installation by virtue of the fact that because of the shaped part, when there is a laterally inverted installation, the insert tool comes to rest against the safety guard before the function element can engage in the opening.

The embodiment according to the invention can be used in various hand-held machine tools deemed appropriate by one skilled in the art, in particular in angle grinders.

DRAWINGS

Other advantages ensue from the following description of the drawings. The drawings show an exemplary embodiment of the invention. The drawings, the specification, and claims contain numerous features in combination. One skilled in the art will appropriately also consider the features individually and will unite them in other suitable combinations.

DESCRIPTION OF THE EXEMPLARY PREFERRED EMBODIMENTS

Figure 1:
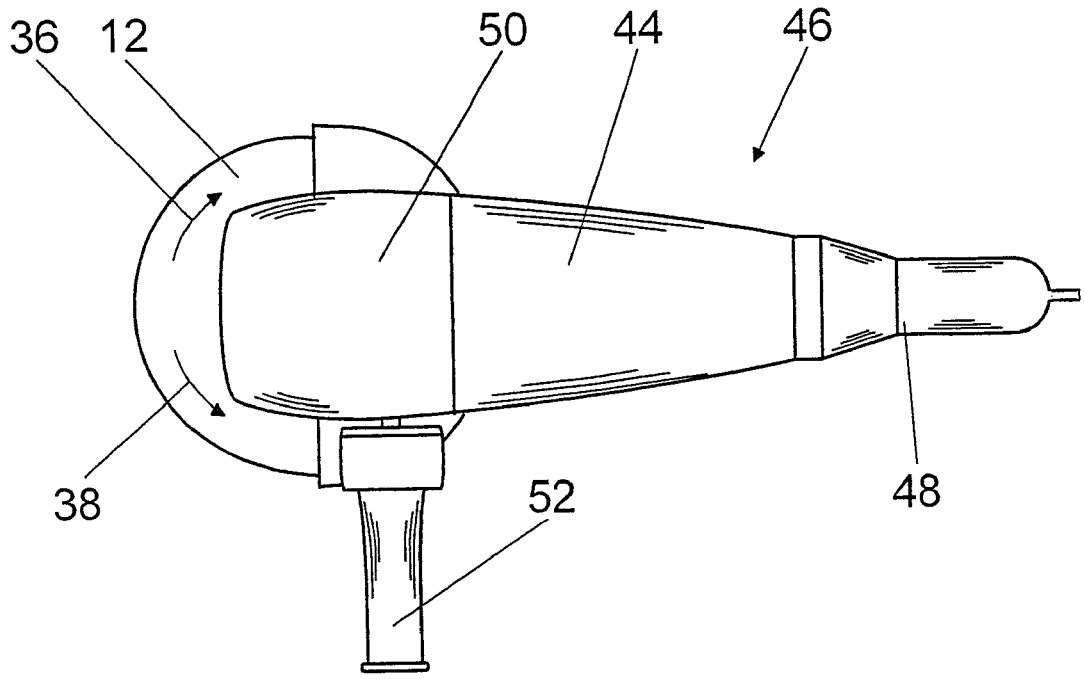
FIG. 1 shows a top view of an angle grinder.
Figure 2:
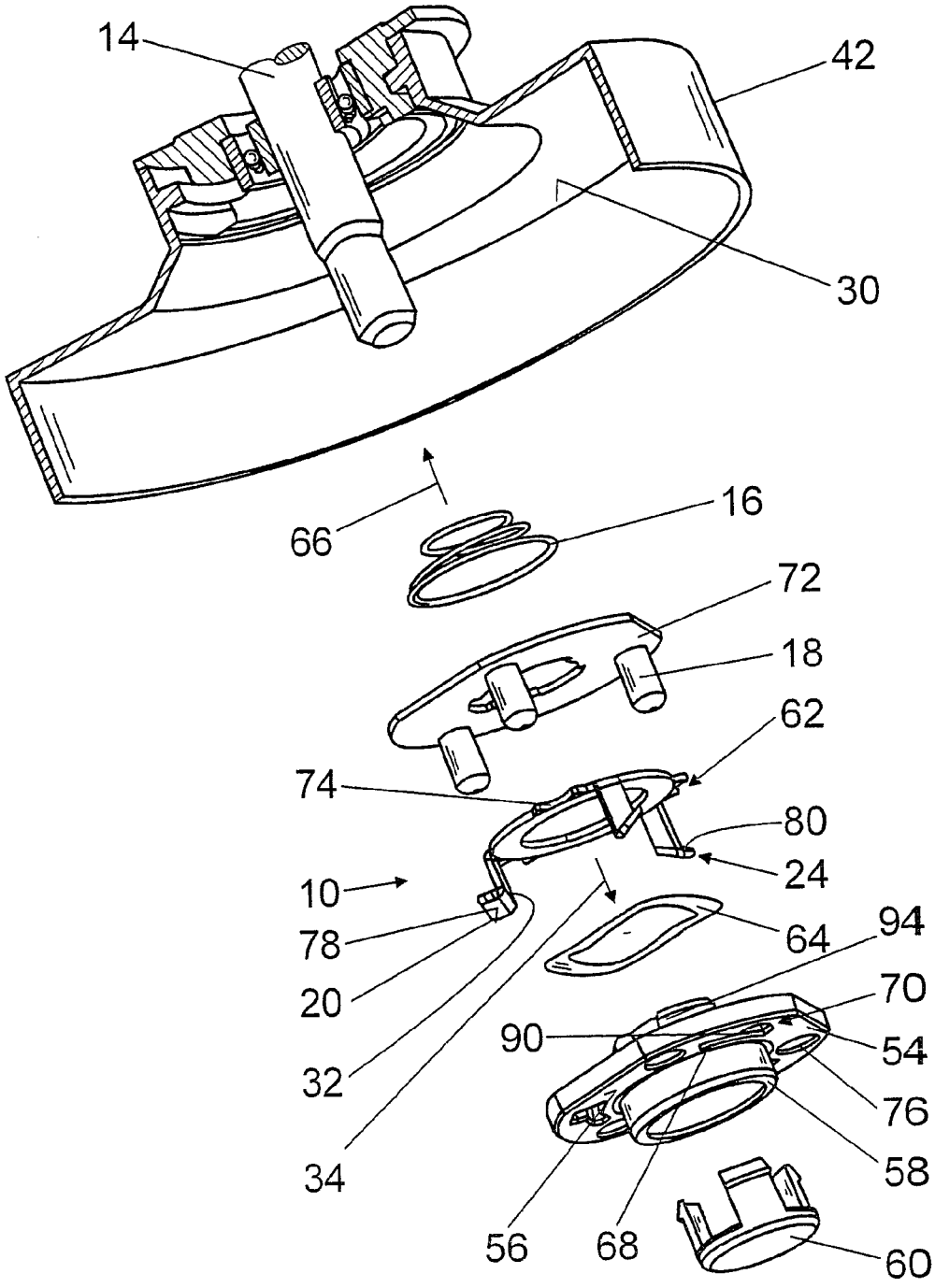
FIG. 2 shows an exploded view of tool-holding socket.

FIG. 1 shows a top view of an angle grinder 44 with an electric motor, not shown in detail, which is contained in a housing 46. The angle grinder 44 can be guided by means of a first handle 48 extending in the longitudinal direction, which is integrated into the housing 46 on the side oriented away from a cutting wheel 12, and by means of a second handle 52 extending lateral to the longitudinal direction, which is fastened to a transmission housing 50 in the vicinity of the cutting wheel 12. By means of a transmission that is not shown in detail, the electric motor can drive a drive shaft 14, whose end oriented toward the cutting wheel 12 is provided with a tool-holding socket that has a driver device 10 (FIG. 2). The tool-holding socket and the cutting wheel 12 comprise a system.

Figure 4:
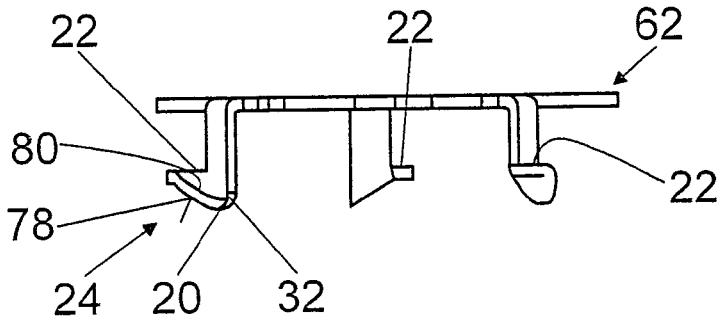
FIG. 4 shows a side view of a sheet metal plate from FIG. 2.

The driver device 10 has a driver flange 54, which constitutes a support surface 56 for the cutting wheel 12 (FIGS. 2 and 4). On the side oriented toward the cutting wheel 12, the driver flange 54 has a collar 58 formed onto it, which radially centers the centering bore 88 of the cutting wheel 12 when it is installed. The driver flange 54 can advantageously absorb radial forces without exerting stress on a release button 60.

On a side of the driver flange 54 oriented away from the cutting wheel 12, there is a sheet metal plate 62 that has three clamping hooks 24, which are formed onto it and of one piece with it, are distributed uniformly in the circumference direction 36, 38, extend in the axial direction 34, and are for axially fixing the cutting wheel 12 (FIGS. 2 and 4). The clamping hooks 24 are formed onto the sheet metal plate 62 through the use of a bending procedure.

Figure 3:
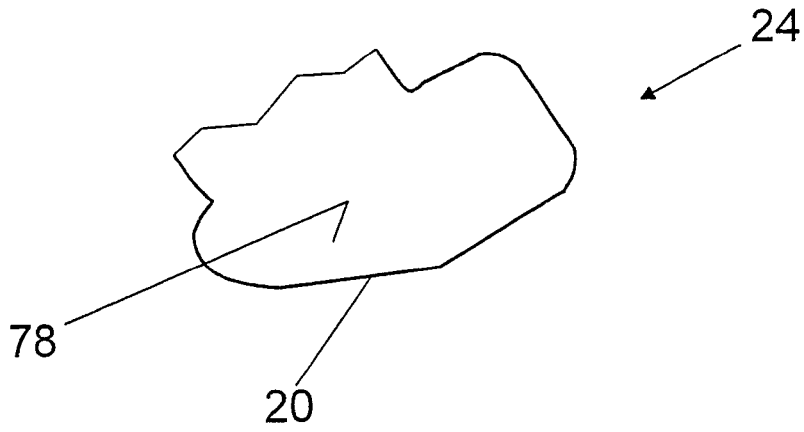
FIG. 3 shows an enlarged top view of a clamping hook from FIG. 2.

The driver flange 54, a shaft spring 64, and the sheet metal plate 62 are preassembled during assembly of the driver device 10. The shaft spring 64 is slid onto a collar 94 of the driver flange 54, which points in the direction oriented away from the cutting wheel 12. Then the clamping hooks 24 of the sheet metal plate 62, which each have a hook-shaped projection at their free end that has an oblique surface 78 pointing in the circumference direction (FIGS. 2, 3, and 4), are guided in the axial direction 34 through openings 70 of the driver flange 54, specifically through wider regions 90 of the openings 70 (FIGS. 2 and 4). Pressing the sheet metal plate 62 and the driver flange 54 together and rotating them in opposite directions compresses the shaft spring 64 and connects the sheet metal plate 62 and the driver flange 54 in a positively engaging fashion in the axial direction 34, 66 by virtue of the fact that the hook-shaped projections are rotated into narrow regions 68 of the openings 70 (FIGS. 2, 3, and 4). Then, loaded by the shaft spring 64, the sheet metal plate 62 is supported against the support surface 56 of the driver flange 54 via edges 22 of the hook-shaped projections, which point axially in the direction oriented away from the cutting wheel 12.

After the preassembly of the shaft spring 64, the driver flange 54, and the sheet metal plate 62 that has the clamping hooks 24 formed onto it, then a helical spring 16 and a driver plate 72, which has three bolts 18 extending in the axial direction 34 distributed evenly over its circumference, are slid onto a drive shaft 14 (FIG. 2).

Then the preassembled unit comprised of the sheet metal plate 62, the shaft spring 64, and the driver flange 54 is mounted onto the drive shaft 14. During installation, the bolts 18 are guided by means of recesses 74 formed onto the circumference of the sheet metal plate 62 and by means of through bores 76 in the driver flange 54, and reach through the through bores 76 in the installed position. The bolts 18 prevent the sheet metal plate 62 and the driver flange 54 from rotating in relation to each other.

The driver flange 54 is press-fitted onto the drive shaft 14 and then secured by means of securing ring that is not shown in detail. Instead of a press-fit connection, however, other connections deemed appropriate by one skilled in the art are also conceivable, for example a threaded connection, etc.

The cutting wheel 12 has a sheet metal hub 40 comprised of a separate component, which has three bores 82 distributed uniformly in the circumference direction 36, 38, whose diameter is slightly greater than the diameter of the bolts 18. In addition, the sheet metal hub 40 has three openings 26 extending in the circumference direction 36, 38 and distributed uniformly in the circumference direction 36, 38, each of which has a narrow region 84 and a wide region 86, whose outer contour is congruent to a projected area of a clamping hook 24 in the direction of the cutting wheel 12.

The diameter of the centering bore of the sheet metal hub 40 is selected so that the cutting wheel 12 can also be clamped to a conventional angle grinder through the use of a conventional clamping system with a clamping flange and spindle nut. This assures a so-called backward compatibility.

By means of their shape, the clamping hooks 24 constitute a first mechanism 32 and a first part of a second mechanism 20, 20' for preventing the cutting wheel 12 from being mounted in a laterally inverted fashion. In a laterally inverted mounting of the cutting wheel 12, if the clamping hook 24 could be inserted into the wide region 86 of the corresponding opening 26 of the sheet metal hub 40 of the cutting wheel 12, then in a rotating motion required to complete the mounting procedure, the first mechanism 32 or an edge of the clamping hook 24 would come into contact with an edge 92 of the opening 26, thus preventing the rotating motion of the cutting wheel 12, and thus preventing the cutting wheel 12 from being fixed in the axial direction 34.

The projected area of the clamping hook 24 in the direction of the cutting wheel 12 is designed to be asymmetrical to an axis 28, which intersects a rotation axis of the cutting wheel 12 at right angles and extends through a center point of the projected area; at the opposite end from a rectangular area, the projected area of clamping hook 24 has a flattened region 20 at one end in a corner region (FIG. 3). The projected area with the flattened region 20, together with the corresponding opening 26 that has a corresponding flattened region 20', constitutes the coding 20, 20' (FIGS. 2, 3, and 4). The coding 20, 20' prevents the cutting wheel 12 from even being slid onto the driver device 10 in the event of a laterally inverted mounting.

Figure 5:
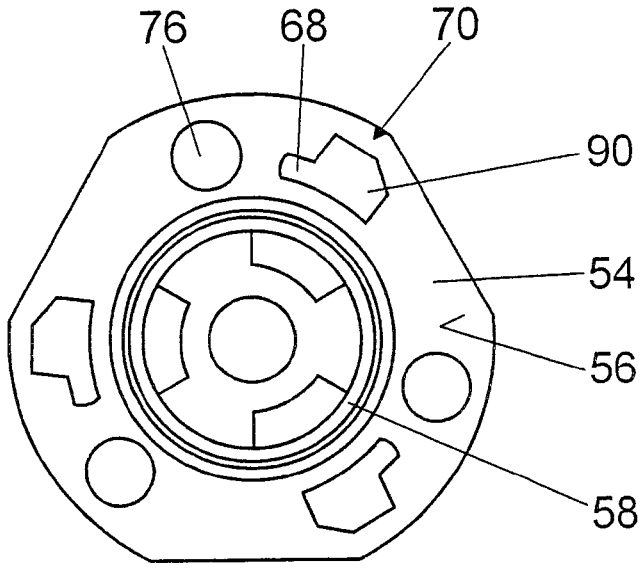
FIG. 5 shows a bottom view of a driver flange from FIG. 2.
Figure 6:
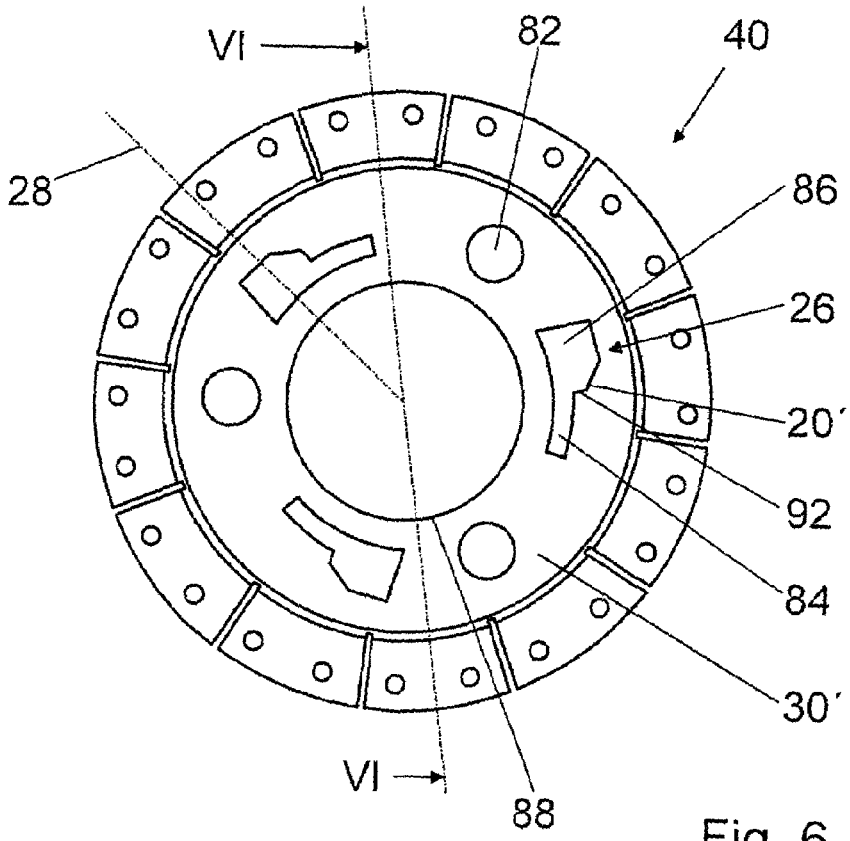
FIG. 6 shows a sheet metal hub of a cutting wheel.
Figure 7:
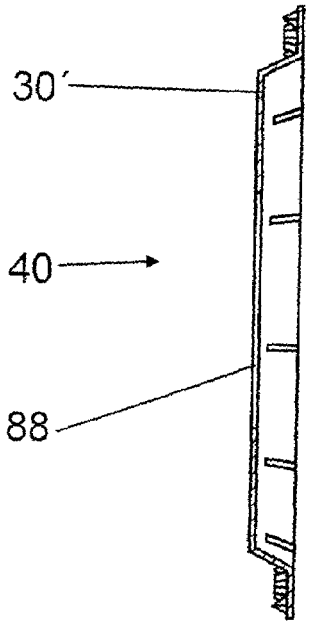
FIG. 7 shows a section along the line VI—VI in FIG. 6.

A riveted connection connects the sheet metal hub 40 of the cutting wheel 12 to an abrasive material and compresses it; the hub is guided in a dish-shaped fashion by means of a shaped part 30' oriented in the axial direction 34. The shaped part 30' constitutes a first part of a coding 30, 30' (FIGS. 5 and 6). The corresponding second part of the coding 30, 30' is constituted by a surface 30 of a safety guard 42 of the tool-holding socket; if the cutting wheel is being mounted in a laterally inverted fashion, the cutting wheel 12 comes to rest against this surface 30 before the clamping hooks 24 can be inserted into the openings 26 (FIG. 2).

When the cutting wheel 12 is installed in a laterally correct position, the cutting wheel 12 is slid with its centering bore 88 onto the centering collar 58 and is radially centered. Then, the cutting wheel 12 is rotated until the clamping hooks 24 engage in the wide regions 86 provided for this in the openings 26 of the sheet metal hub 40. Pressing the sheet metal hub 40 against the support surface 56 of the driver flange 54 causes the bolts 18 to slide into the through bores 76 and causes the driver plate 72 to slide axially in the direction 66 oriented away from the cutting wheel 12, counter to a spring force of the helical spring 16 on the drive shaft 14.

If the hook-shaped projections of the clamping hooks 24 are guided through the wide regions 86 of the openings 26 of the sheet metal hub 40 (FIG. 2), then rotating the sheet metal hub 40 counter to the drive direction 36 causes the hook-shaped projections to be slid into the arc-shaped narrow regions 84 of the openings 26 of the sheet metal hub 40. In the process of this, the sheet metal plate 62 with the clamping hooks 24 is slid counter to the pressure of the shaft spring 64 by means of the oblique surfaces 80 in the direction 34 until the edges 22 of the hook-shaped projections come to rest in the arc-shaped narrow regions 84 laterally adjacent to the openings 26 of the sheet metal hub 40. In the installed position, the shaft spring 64 presses the cutting wheel 12 against the support surface 56 by means of the edges 22 of the hook-shaped projections of the clamping hooks 24.

In a final position or when an operating position of the cutting wheel 12 has been reached, the bores 82 in the sheet metal hub 40 come to rest over the through bores 76 of the driver flange 54. Due to the spring force of the helical spring 16, the bolts 18 slide axially in the direction 34 toward the cutting wheel 12, engage in detent fashion in the bores 82 of the sheet metal hub 40, and fix it in a positively engaging fashion in both circumference directions 36, 38. The detent engagement produces a detent engagement sound that is audible to the operator, which notifies the operator that the tool is ready for use.

Alternatively, but not shown, the fastening elements and the oblong holes in the sheet metal hub can also be embodied rotated by 180° so that the mounting direction is reversed and the sheet metal hub is rotated in the drive direction when being mounted. If the fastening elements are embodied rotated by 180°, then during operation, an oblique surface travels ahead of a lower leading edge of the fastening element so that a sort of deflector is produced, which effectively prevents the leading edge from digging in, e.g. when it comes into contact with an edge of a work piece.

REFERENCE NUMERALS

10 driver device 56 support surface
12 insert tool 58 collar
14 drive shaft 60 release button
16 spring element 62 sheet metal plate
18 detent element 64 helical spring
20 mechanism 66 direction
22 edge 68 region
24 function element 70 opening
26 opening 72 driver plate
28 axis 74 recess
30 coding 76 through bore
32 mechanism 78 oblique surface
34 axial direction 80 oblique surface
36 circumference direction 82 bore
38 circumference direction 84 region
40 hub 86 region
42 safety guard 88 centering bore
44 angle grinder 90 region
46 housing 92 edge
48 handle 94 collar
50 transmission housing
52 handle
54 driver flange
56 support surface
58 collar
60 release button
62 sheet metal plate
64 helical spring
66 direction
68 region
70 opening
72 driver plate
74 recess
76 through bore
78 oblique surface
80 oblique surface
82 bore
84 region
86 region
88 centering bore
90 region
92 edge
94 collar

The invention claimed is:

1. A system with a tool-holding socket, which has a driver device (10) that can be used to operationally connect an insert tool (12) to a drive shaft (14), and has an insert tool (12), characterized in that the insert tool (12) can be operationally connected to the driver device (10) by means of at least one detent element (18), which is supported so that can move in opposition to a spring element (16), engages in detent fashion in an operating position of the insert tool (12), end fixes the insert tool (12) in a positively engaging fashion, wherein at least part of a mechanism (20, 20, 30,

30', 32) for preventing a laterally inverted installation of the insert tool (12) is formed onto at least the tool-holding socket.

2. The system according to claim 1, characterized in that the driver device (10) has at least one function element (24), which constitutes at least a part of the mechanism (20, 20', 32).

3. The system according to claim 1, characterized in that at least one corresponding mechanism (20, 20', 30, 30') for preventing a laterally inverted installation of the insert tool (12) is formed onto the tool-holding socket and onto the insert tool (12).

4. The system according to claim 2, characterized in that the function element (24) has a projected area in the direction of the insert tool (12), which projected area is designed to be asymmetrical to an axis (28) that intersects a rotation axis of the insert tool (12) at right angles and extends through a center point of the projected area, wherein the insert tool (12) has an opening (26) that is at least partially congruent to the projected area arid corresponds to the function element (24).

5. The system according to claim 3, characterized in that the insert tool (12) has a disk-shaped hub (40) comprised of a separate component.

6. The system according to claims 3, characterized in that the insert tool (12) has a hub (40) with a shaped part (30') oriented in the axial direction (34).

7. The system according to claim 6, characterized in that the shaped part (30') constitutes a part of the mechanism (30, 30').

8. The system according to claim 6, characterized in that the hub (40) is dish-shaped.

9. A tool-holding socket for a system according to claim 1.

10. An insert tool for a system according to claim 1.

* * * * *